US005192129A

United States Patent [19]

Figueroa

[11] Patent Number: 5,192,129

[45] Date of Patent: * Mar. 9, 1993

[54] CUSTOMIZED LIGHT REFLECTOR

[76] Inventor: Luisito A. Figueroa, c/o Excel Products Products, Inc., Suite 504, Jovan Condominium, 600 Shaw Blvd., Mandaluyong, Metro Manila, Philippines

[ * ] Notice: The portion of the term of this patent subsequent to Oct. 29, 2008 has been disclaimed.

[21] Appl. No.: 756,076

[22] Filed: Sep. 6, 1991

Related U.S. Application Data

[63] Continuation-in-part of Ser. No. 624,605, Dec. 10, 1990, Pat. No. 5,062,030.

[51] Int. Cl.[5] ..... F21V 7/12

[52] U.S. Cl. ..... 362/346; 362/241; 362/260

[58] Field of Search ..... 362/241, 260, 346, 341

[56] References Cited

U.S. PATENT DOCUMENTS

| | | | |
|---|---|---|---|
| 2,323,073 | 6/1943 | Netting | 362/225 |
| 3,524,052 | 8/1970 | Iroue | 362/346 |
| 3,652,848 | 3/1972 | Miller et al. | 362/410 |
| 3,700,877 | 10/1972 | Wilson | 240/3 |
| 3,829,677 | 8/1974 | Duarte DeLlano | 240/51.11 R |
| 3,860,903 | 1/1975 | Van Steenhoven | 240/47 |
| 4,174,533 | 11/1979 | Barthes et al. | 362/346 |
| 4,499,529 | 2/1985 | Figueroa | 362/283 |
| 4,599,684 | 7/1986 | Lee | 362/346 |
| 4,814,954 | 3/1989 | Spitz | 362/217 |
| 4,975,812 | 12/1990 | Cole, Jr. | 362/225 |
| 5,032,959 | 7/1991 | Brass | 362/238 |
| 5,062,030 | 10/1991 | Figueroa | 362/346 |

*Primary Examiner*—Ira S. Lazarus
*Assistant Examiner*—L. Heyman
*Attorney, Agent, or Firm*—Julian Caplan

[57] ABSTRACT

A light reflector for use with a lighting fixture substantially concave in one plane of intersection and disposed in a direction parallel to an elongated light source comprising a central section optionally intersected by other light reflecting planes and a pair of arcuatte wing sections positioned on opposite sides of the central section. The light reflector may be formed of a light reflective material or coated with light reflective material.

6 Claims, 3 Drawing Sheets

CUSTOMIZED LIGHT REFLECTOR

RELATED APPLICATION

This application is a continuation-in-part application based upon co-pending application Ser. No. 624,605, filed Dec. 10, 1990, now U.S. Pat. No. 5,062,030, issued Oct. 29, 1991, entitled CUSTOMIZED LIGHT REFLECTOR.

BACKGROUND OF THE INVENTION

1. Field of the Invention

This invention relates generally to light reflectors, and more particularly this invention relates to a light reflector that can be customized to fit a variety of standard lighting fixtures having one or more light sources such as a fluorescent bulb.

The art of lighting fixtures while extremely old has experienced an increase in activity in recent years with the development of a new and specialized light reflectors to maximize illumination and to uniformly distribute light throughout an area. Commonly available lighting fixtures include ceiling mounted housings available in a variety of sizes and shapes to accommodate one or more bulbs.

Research in this field has established that when the specific need arises for a light reflector to be installed to the housing of an existing lighting fixture, daily users of the fixture often find it difficult to procure a ready-to-fit light reflector. As a result, users usually resort to a made-to-order light reflector which entails more expenditure aside from the inconveniences inherent in obtaining one.

In view of the foregoing disadvantages of existing light reflectors made for conventional lighting fixtures, the inventor has developed the present reflector which can be customized to fit a wide variety of shapes and sizes of reflectors. It is noteworthy for its simple and easy assembly, reliability and practicality.

2. Description of Related Art

This invention is an improvement over Applicant's prior U.S. Pat. No. 4,499,529, which discloses several of the features of the present invention. In the present invention the central section of the reflector has at least a substantial part of its surface disposed in a horizontal plane to reflect light from a light source downwardly (it being understood that the term "downwardly" assumes that the fixture is positioned horizontally above the source).

SUMMARY OF THE INVENTION

In accordance with the present invention, the light reflector has a plurality of light reflecting planar surfaces inclined towards the light source and capable of directing the light rays downwardly and uniformly over a greater area. The light reflecting planar surfaces may be fixed, and in the preferred embodiment, the angular disposition of each of the planar surfaces is predetermined.

Other embodiments disclosed by the present invention are specific variations of the basic reflector configuration which may be utilized in accordance with the teaching disclosed in my previous invention bearing U.S. Pat. No. 4,499,529, issued on Feb. 12, 1985. An important feature of the invention is a pair of arcuate wing sections defining a series of light reflective angled planar portions symmetrically joined to a central section, said sections being capable of maximizing the light emitted from a light source directed downwardly and uniformly.

The angled planar reflecting portions are positioned symmetrically and coextensively with the length of the light source. As mounted, these planar reflecting portions define a generally concave contour. The reflecting surfaces are advantageously coated with aluminum or silver by a vacuum metalization process to effectively intercept and reflect light emitted by the light source.

The reflector proposed by the invention is so dimensioned and configured such that its size and shape could be readily assembled and/or customized to fit almost all existing standard lighting fixtures. For instance, a four-bulb elongated light source could be fitted easily with two of these reflectors to attain the desired maximum illumination of a predetermined area.

Other objects and advantages of the invention will be fully understood from the following detailed description of the preferred embodiment when read in conjunction with the appended drawings.

BRIEF DESCRIPTION OF THE DRAWINGS

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
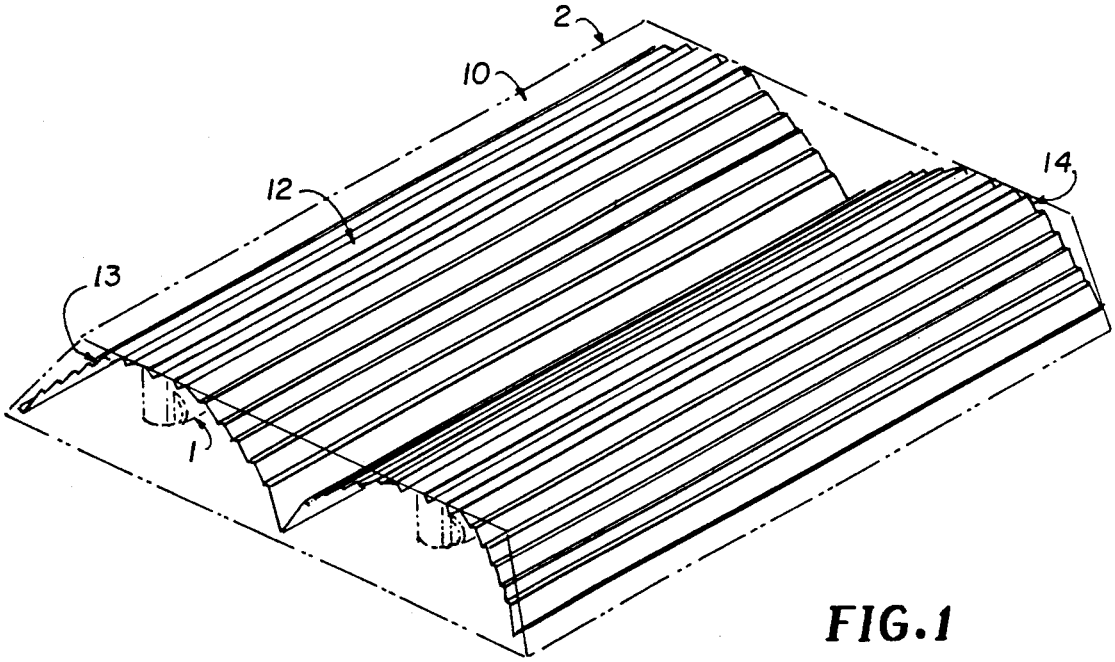
FIG. 1 is a perspective view of a light reflector in accordance with the invention.

Referring now in detail to the drawings, there is illustrated in FIG. 1 the concave light reflector generally designated by reference numeral 10 seated in an outline of a light fixture, denoted 2. Light reflector 10 is horizontal and located above the light source, designated 1, to maximize the light reflected into the area below light source 1. It will be understood that the reflector 10 need not be horizontally disposed, but for the purpose of this Specification and the accompanying claims, it will be so assumed. The following embodiments of the present invention show light reflector 10 disposed along the length of a fluorescent light bulb 1 parallel with this elongated light source, but it is understood that light reflector 10 could be positioned above lights in various configurations, such as above a row of incandescent light bulbs.

Light reflector 10 may be formed from a variety of rigid materials with or without inherent light reflective properties. In the preferred embodiment, light reflector 10 is formed from a metal sheet or plastic material. It will be understood that other materials are anticipated to be within the present invention. If light reflector 10 is not formed of a reflective material, such as aluminum, the underside of the sheet is glazed or overlaid with a good reflecting material, such as aluminum or silver. It has been found advantageous to deposit these metals along the entire underside of reflector 10 using a known vacuum metalization process.

Figure 2:
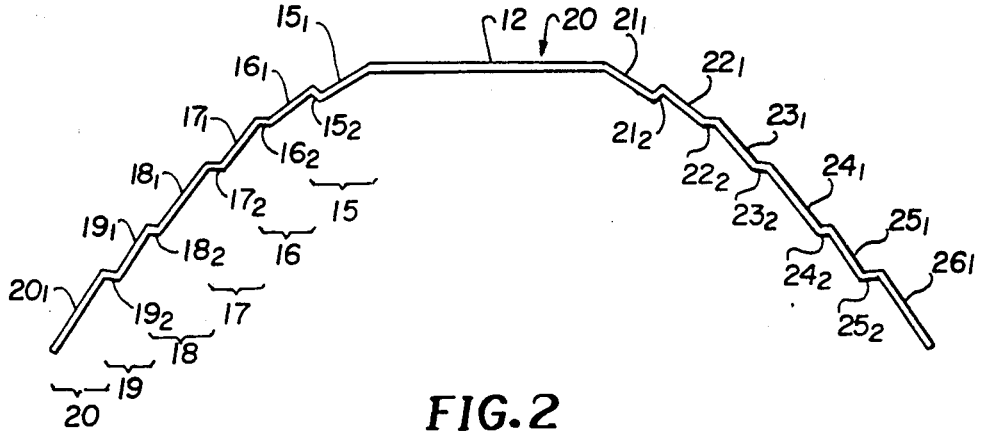
FIG. 2 is an end elevation view of the light reflector shown in FIG. 1.

Referring now to FIG. 2, reflector 10 comprises a substantially flat central light reflecting section, designated 12, and a pair of arcuate light reflecting wing sections, designated 13 and 14, symmetrically and parallelly positioned on either side of central section 12. Wing sections 13 and 14 are formed into a substantially concave shape to maximize light reflection. Wing section 13 has a plurality of individually dimensioned and oriented light reflective angled planar portions, respectively indicated by the reference numerals 15, 16, 17, 18, 19 and 20, and section 14 has portions 21, 22, 23, 24, 25, 26.

Although the accompanying drawings show six portions on each wing section 13,14, this number is subject to modification.

Portions 15–26 comprise first surfaces denoted by the subscript 1 and second surfaces denoted by the subscript 2, e.g, $15_1$, $15_2$, $16_1$, $16_2$, etc... Each first surface $15_1$, etc., extends downwardly-outwardly relative to a horizontal plane, and each second surface $15_2$, etc., extends outwardly-upwardly from the lower edge of its corresponding first surface $15_1$. The first surface $15_1$, etc., is substantially greater in length than its corresponding second surface $15_2$, etc.

Figure 3:
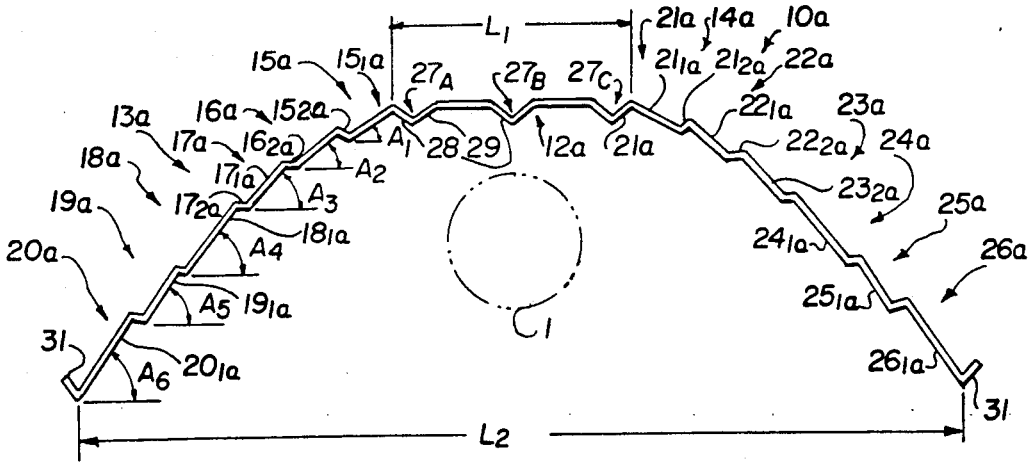
FIG. 3 is an end elevation view of another embodiment of the invention.

Central section 12 alternatively may be intersected by at least one pair of planes such as the convex V-shaped reflecting portions, designated 27A,B,C in FIG. 3. V-shaped portions 27A,B,C are formed of two opposed intersecting reflecting planar surfaces 28 and 29 having a centrally positioned apex. Reflecting surfaces 28 and 29 are positioned at approximately 1 to 80 degrees relative to the horizontal. Light rays emitted from the light source 1 impinge on the reflecting planar surfaces of reflector 10 and are reflected away from light source 1 to prevent light source illumination losses from diffusion in a substantially glare-free manner. The outermost and widest planar reflective surfaces 20 and 26 each have outwardly projecting inclined extensions 31 at the free ends thereof. Without V-portions 27, a greater degree of light is reflected toward the peripheral areas to be illuminated below the light source.

The V-shaped reflecting structures 27A, 27B and 27C disposed in the central section 12 also serve to reinforce and make these sections rigid to prevent wing sections 13 and 14 from drooping.

Figure 4:
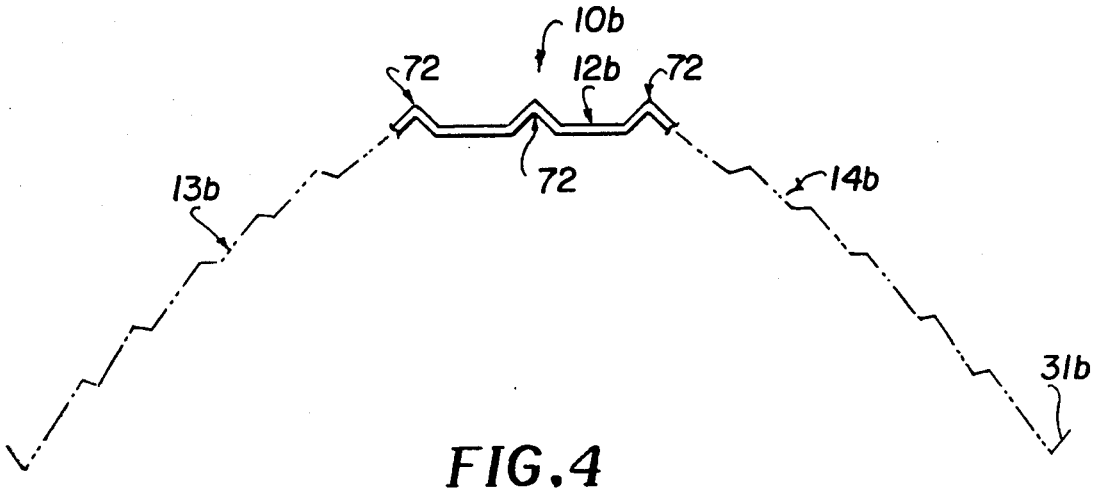
FIGS. 4, 5 and 6 are fragmentary end elevation views of other embodiments of the central light reflecting section of the light reflector shown in FIG. 2.
Figure 5:
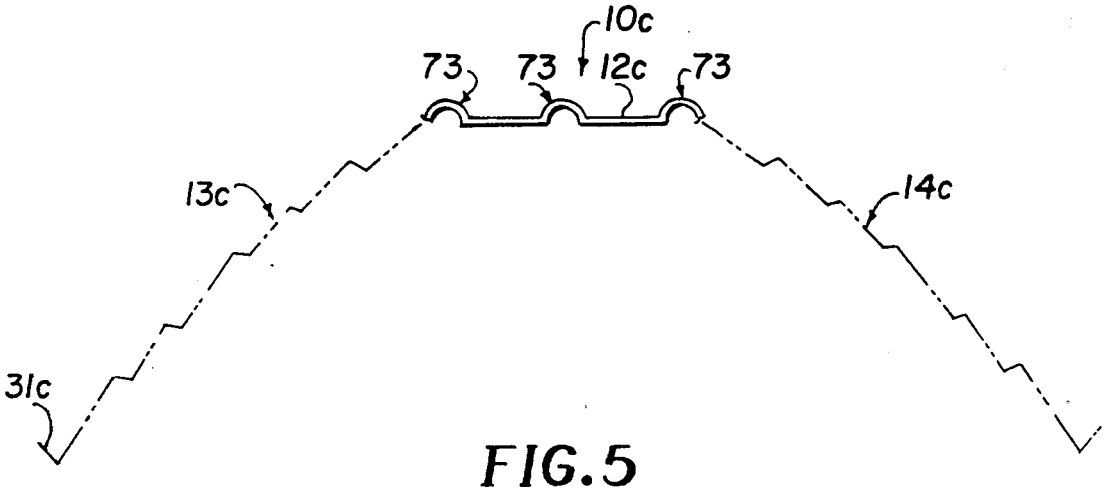
Figure 6:
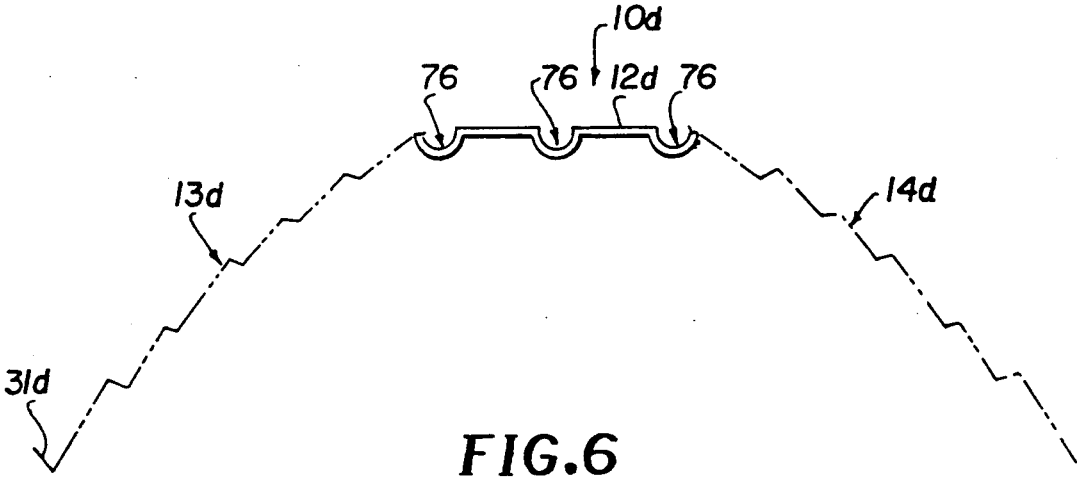

Central section 12 is alternatively intersected by planes with inverted V-shaped portions 72 (see FIG. 4), inverted and upright U-shaped portions 73,74 (see FIGS. 5 and 6), semi-elliptical, semi-parabolic, or other curved surface &:o attain the desired level and distribution of light reflection.

To readily fit reflector 10 in existing fixtures and maintain its reflective properties, the reflecting portions disclosed in the embodiments shown in FIGS. 2 to 9 are individually dimensioned and oriented at varying angles and arcuations. These angles and arcuations are subject to the height and width of the fixtures.

In the embodiment shown in FIG. 3, it has been found advantageous to form light reflector 10 with the following dimensions and angles, as depicted in FIG. 3:

(a) First planar reflective surfaces $15_1$a and $21_1$a closest to central section 12 are approximately 5 to 28 millimeters wide and inclined at an angle in the range of approximately 24 to 34 degrees ($A_1$a) relative to the horizontal;

(b) The primary intermediate reflective section defining the second and third planar reflective surfaces $16_1$a and $22_1$a and $17_1$a and $23_1$a closest to the first planar reflective surfaces $15_1$a and $21_1$a are approximately 6 to 30 millimeters wide and respectively inclined at an angle of approximately 31 to 41 degrees ($A_2$) and 41 to 51 degrees ($A_3$) relative to the horizontal;

(c) The secondary intermediate reflective section defining the fourth and fifth planar reflective surfaces $18_1$a and $24_1$a and $19_1$a and $25_1$a closest to said third planar surfaces $17_1$a and $23_1$a both approximately 6 to 30 millimeters wide and respectively inclined at an angle of approximately 42.5 to 52.5 degrees ($A_4$) and 47 to 57 degrees ($A_5$) relative to the horizontal;

(d) The outermost and widest planar reflective surfaces $20_1$a and $26_1$a closest to said fifth planar surfaces $19_1$a and $25_1$a are approximately 20 to 38 millimeters wide and inclined at an angle of 47 to 57 degrees ($A_6$) relative to the horizontal;

(e) The outwardly projecting inclined extensions 31 are approximately 1 to 38 millimeters in width;

(f) Central section 12 forming the apex of the reflector is approximately 2 to 9 cm. in width ($L_1$); and (g) The lateral dimension of the span ($L_2$) which is approximately 22 to 29 centimeters in width.

Figure 7:
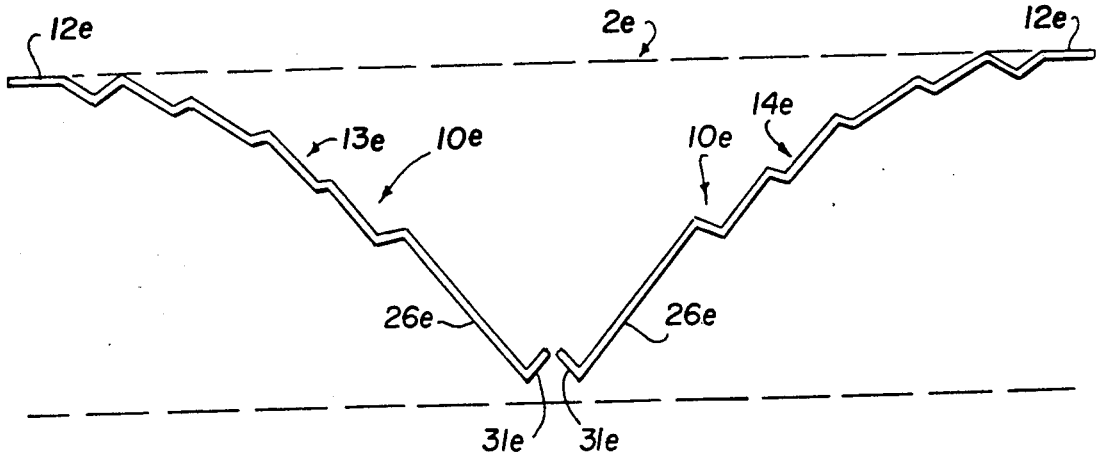
FIG. 7 is an schematic end view of one way of installing a pair of the said light reflectors, e.g., in a two lamp light fixture, the outwardly projecting inclined free ends being in juxtaposed relation.
Figure 8:
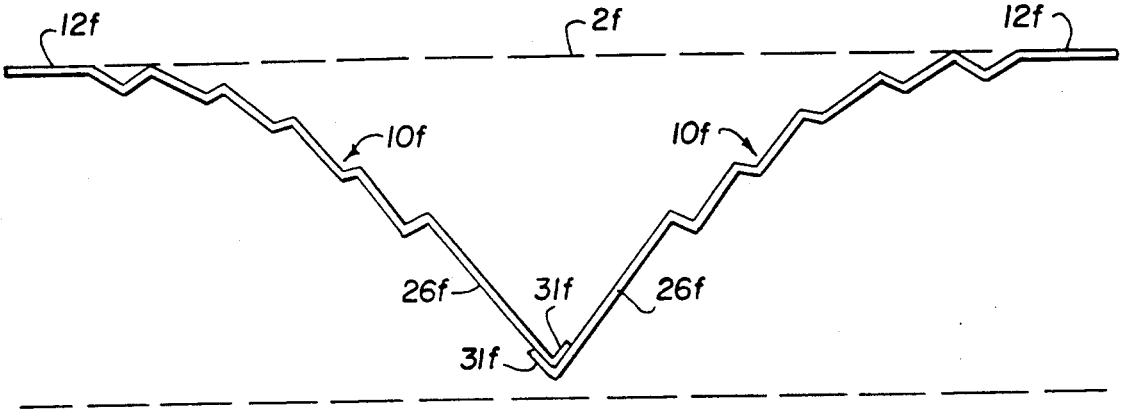
FIG. 8 is a view similar to FIG. 7 wherein the projecting free ends thereof being in superimposed relation.
Figure 9:
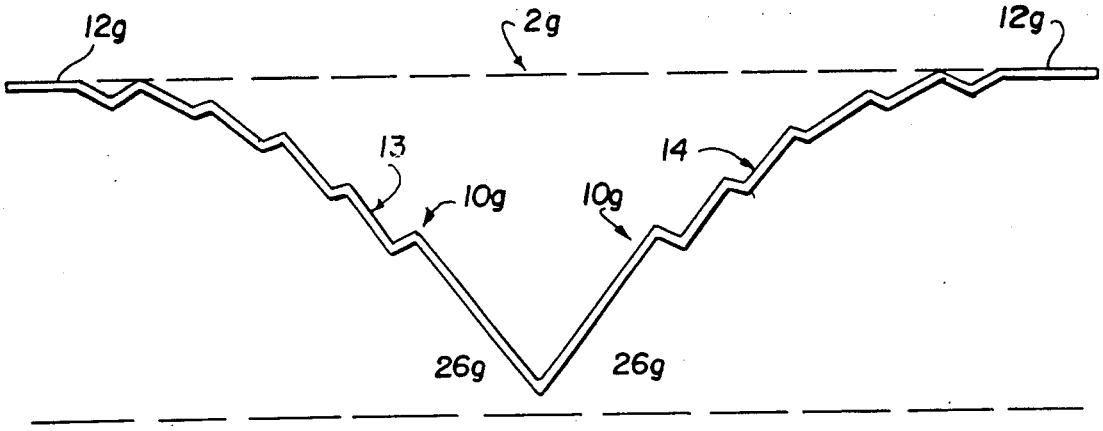
FIG. 9 is a view similar to FIG. 7 showing the adjacent wing sections formed integral.

Outermost surfaces $20_1$a and $26_1$a terminate at the free ends thereof with outwardly projecting inclined extensions 31 to allow more than one light reflector 10 to fit together in one fixture, as illustrated in FIGS. 7, 8, 9. For single reflector fixtures, FIG. 3 shows light reflector 10 alternatively constructed without extensions. Two reflectors may also be advantageously connected without extensions, as illustrated in FIG. 9.

Many of the elements of FIGS. 3 to 9 inclusive resemble those of the previous modifications and the same reference numerals, followed by subscripts a to g, respectively, refer to corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described n order to best explain the principles of the invention and it practical application, to thereby enable others skilled in the art to best utilize the invention and various embodiments with various modifications as are suited to the particular use contemplated. It is intended that the scope of the invention be defined by the Clams appended hereto and their equivalents.

What is claimed is:

1. A light reflector for use with a lighting fixture concave disposed in a direction parallel to an elongated light source, said reflector comprising:

a central section, said central section having at least a substantial part of its surface disposed in a horizontal plane to reflect light from said source downwardly said central section being intersected by at least one pair of opposed, longitudinally extending ridges, the sums of the widths of said ridges being substantially less than the part of said central section disposed in said horizontal plane; and a pair of substantially arcuate wing sections, each of said wing sections being symmetrically positioned on one side of said central section opposite the other wing section and parallel to said central section, said wing sections being connected to said central section to form a substantially concave shape and comprising a plurality of individually dimensioned and oriented light reflective portions, each said portion comprising a first surface and a second surface, said first surface extending downwardly-outwardly relative to a horizontal plane, and said second surface extending outwardly-upwardly from the lower edge of its corresponding first surface, said first surface being substantially greater in length than its corresponding second surface.

2. The light reflector as defined in claim 1 wherein, said first surfaces have dimensions in the range of 5 to 55 millimeters.

3. The light reflector as defined in claim 1 wherein, the angles between said first surfaces and the horizontal are in the range of 24 to 57 degrees.

4. A light reflector for use with a lighting fixture concave disposed in a direction parallel to an elongated light source, said reflector comprising:

a central section, said central section having at least a substantial part of its surface disposed in a horizontal plane to reflect light from said source downwardly; and a pair of substantially arcuate wing sections, each of said wing sections being symmetrically positioned on one side of said central section opposite the other wing section and parallel to said central section, said wing sections being connected to said central section to form a substantially concave shape and comprising a plurality of individually dimensioned and oriented light reflective portions, each said portion comprising a first surface and a second surface, said first surface extending downwardly-outwardly relative to a horizontal plane, and said second surface extending outwardly-upwardly from the lower edge of its corresponding first surface, said first surface being substantially greater in length than its corresponding second surface, and wherein, said central section is intersected by at least one pair of opposed reflecting planar surfaces connected at their non-intersecting ends to form the apex of concave V-shaped structure.

5. A light reflector for use with a lighting fixture concave disposed in a direction parallel to an elongated light source, said reflector comprising:

a central section, said central section having at least a substantial part of its surface disposed in a horizontal plane to reflect light from said source downwardly; and a pair of substantially arcuate wing sections, each of said wing sections being symmetrically positioned on one side of said central section opposite the other wing section and parallel to said central section, said wing sections being connected to said central section to form a substantially concave shape and comprising a plurality of individually dimensioned and oriented light reflective portions, each said portion comprising a first surface and a second surface, said first surface extending downward-outwardly relative to a horizontal plane, and said second surface extending outwardly-upwardly from the lower edge of its corresponding first surface, said first surface being substantially greater in length than its corresponding second surface.

and wherein, the lowermost second surfaces projects outwardly-upwardly to first with a corresponding lowermost second surface of another light reflector as defined in claim 1.

6. The reflector as defined in claim 1 wherein, said reflector is lined with a coating of aluminum applied by a vacuum metalization process.

* * * * *